United States Patent [19]

Lee

[11] 4,293,178

[45] Oct. 6, 1981

[54] COUPLING FOR AN ELECTRIC CABLE

[76] Inventor: Hop Lee, 2455 - 24th Ave., San Francisco, Calif. 94116

[21] Appl. No.: 63,393

[22] Filed: Aug. 3, 1979

[51] Int. Cl.[3] ..... H01R 13/585

[52] U.S. Cl. ..... 339/103 R; 339/122 R

[58] Field of Search ..... 339/103, 104, 268 S, 339/270 R, 273; 24/136 R, 263 SW

[56] References Cited

U.S. PATENT DOCUMENTS

| | | | |
|---|---|---|---|
| Re. 17,880 | 11/1930 | Stoeltzlen | 339/268 S |
| 2,463,144 | 3/1949 | Buchanan | 339/268 S |
| 2,896,496 | 7/1959 | Jansen | 24/136 R |

FOREIGN PATENT DOCUMENTS

| | | | |
|---|---|---|---|
| 332011 | 11/1919 | Fed. Rep. of Germany | 339/103 R |
| 709240 | 8/1941 | Fed. Rep. of Germany | 24/136 R |
| 1489532 | 3/1969 | Fed. Rep. of Germany | 339/103 C |
| 749062 | 5/1956 | United Kingdom | 339/103 R |

*Primary Examiner*—John McQuade

*Attorney, Agent, or Firm*—Alvin E. Hendricson; William R. Piper

[57] ABSTRACT

A coupling for an electric cable for connecting the cable to the wall of an electric outlet box so that the cable cannot be pulled free of the box, the cable wires being connected to the electrical unit in the box. A modified form of the device shows the coupling connecting the cable to an electric socket and again the cable cannot be pulled free of the socket. The coupling includes a cable receiving sleeve in which a plurality of longitudinally wedge-shaped grooves are provided. Wedges are inserted into the grooves and they are provided with teeth on their inner surfaces for gripping the cable. The inclination of the teeth is such as to grip the cable and prevent its withdrawal from the coupling.

2 Claims, 6 Drawing Figures

FIG. 2-A

COUPLING FOR AN ELECTRIC CABLE

CROSS REFERENCE TO RELATED APPLICATION

In my co-pending patent application on an electric outlet box containing twin electric sockets, Ser. No. 32,545, filed Apr. 23, 1979 and issued as U.S. Pat. No. 4,211,464 on July 8, 1980, I showed an electric outlet box containing twin electric sockets. A coupling of novel construction was used for connecting the cable to the box and in the present case I show the structure of the coupling when used for the box or when used for the coupling to connect the cable to a socket.

SUMMARY OF THE INVENTION

An object of my invention is to provide a coupling for an electric cable in which a plurality of wedge-shaped members are used for gripping the cable and these members have teeth that contact the cable and grip it, novel means being used for preventing any longitudinal movement of the cable with respect to the coupling when the cable was subjected to any external pull on it.

BRIEF DESCRIPTION OF THE DRAWINGS

FIG. 2A is a section along the line 2A—2A of FIG. 1.

DESCRIPTION OF THE PREFERRED EMBODIMENTS

Figure 1:
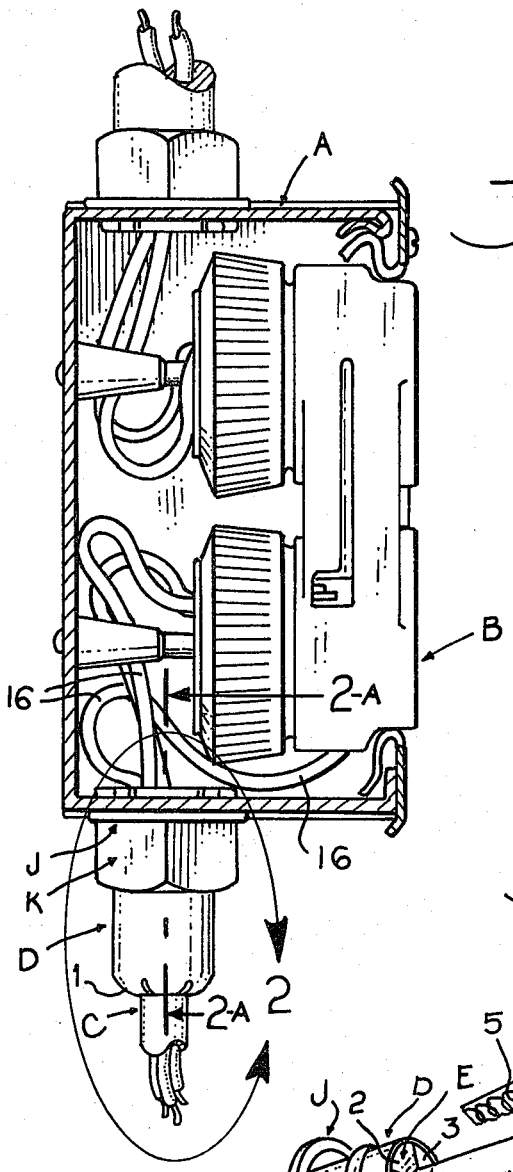
FIG. 1 is a sectional view of the electric box housing the twin electric sockets and is some what similar to FIG. 4 in U.S. Pat. No. 4,211,464. My cable coupling is shown in elevation and is connected to the box.

In carrying out my invention, I show an electric outlet box A, in section in FIG. 1. The box houses twin electric sockets indicated generally at B. These two items are described and claimed in my co-pending patent application, Ser. No. 32,545, now U.S. Pat. No. 4,211,464. The present invention comprises the coupling shown in the circled arrow 2 in FIG. 1 and illustrated in the exploded view of FIG. 2. The coupling is attached to the electric outlet box A in FIG. 1 and is attached to an electric socket in FIGS. 4 and 5. I will first describe the different parts of the coupling shown in FIGS. 1, 2 and 3, and then will describe the coupling when designed to be connected to an electric socket.

Figure 2:
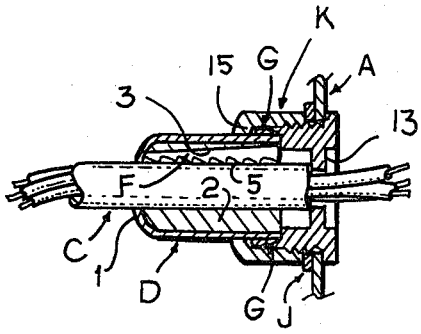
FIG. 2 is an exploded view of the parts forming the coupling shown in elevation in the circled portion 2 of FIG. 1.
Figure 3:
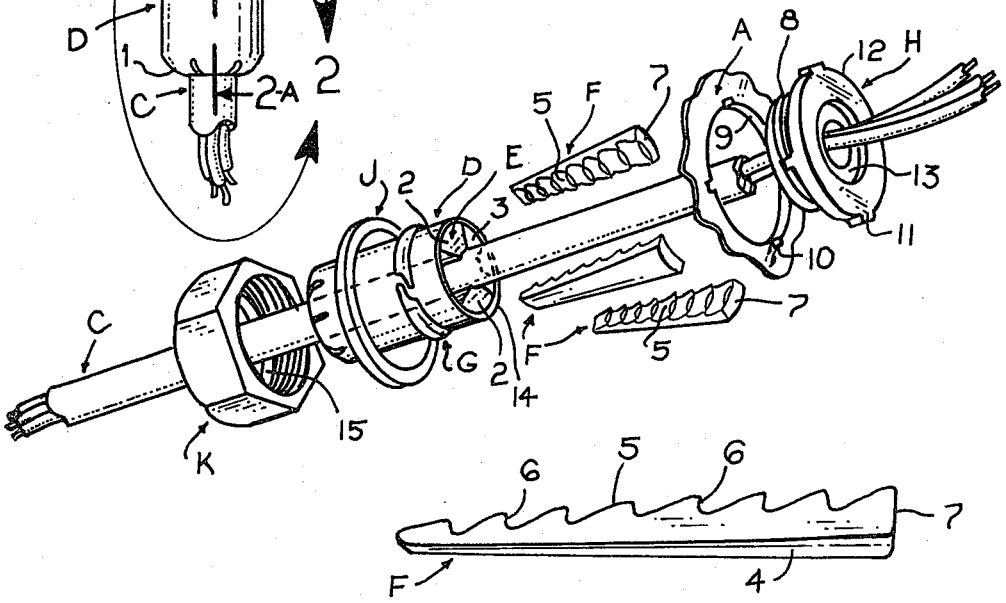
FIG. 3 is an enlarged side view of one of the wedges showing the teeth thereon.

Referring to FIGS. 1 to 3 inclusive, I show in the exploded view of FIG. 2, a cable C extending through a cylindrical sleeve D, and this sleeve has an inwardly crimped end 1 that will reduce the interior diameter of the sleeve to one just large enough to receive the outer diameter of the cable C. The sleeve D, is metal and its enlarged interior receives a liner E, made of wood. The liner E has three inwardly extending projections 2, see also FIG. 2A, and these are angularly spaced apart to provide three wedge-shaped recesses about the outer cylindrical surface of the cable as clearly shown in FIG. 2. The three wedge-shaped recesses 3 removably receive three wedges F of the type shown in FIGS. 2, 2A and 3.

In FIG. 3 an enlarged side elevation of one of the wedges F is shown. The outer surface 4 is rounded to conform to the interior of the cylindrical wall of the sleeve D. Each wedge F has teeth 5 on its inner surface and the edges of these teeth are made concave so as to contact the outer cylindrical surface of the cable C. FIGS. 2 and 3 further show the teeth angular in shape with their vertical faces 6 facing toward the enlarged end 7 of the wedge. When the wedges are inserted into place in the wedge-shaped recesses 3, the teeth 5 will grip the cable and prevent any outward pull on the cable from moving the cable with respect to the wedges. In other words, the wedges anchor the cable in the sleeve D.

The cylinder D has a split ring G, encircling it as shown in FIG. 2. In coupling the cable C to the box A, a flanged cylinder H, is positioned on the inside of the wall of the box A so that the exteriorly threaded portion 8 of the cylinder will extend through an opening 9 in the box wall and the rim of the opening has recesses 10 for receiving projections 11 on an exterior flange 12 of the cylinder H. Also, the cylinder H has an inwardly extending flange 13 providing a stop for the end of the cable C that is received within the coupling. FIG. 2A shows the end of the cable abutting the flange 13.

The three wedges F, are loosely placed in their wedgeshaped recesses 3 of the liner E, and then the sleeve D is moved along the cable C until the end 14 of the sleeve contacts the end of the threaded portion 8 of cylinder H, see FIG. 2A. This will force the wedges F down into binding engagement with the cable C, for anchoring the cable in the sleeve. The shape of the teeth 5 on the wedges F will prevent any movement of the cable to the left in FIG. 2A should anyone pull on the cable.

Next, the split ring G, is moved along the sleeve D, until it is received partially within the chamfered end of the cylinder H, see FIG. 2A. A washer J, is moved over the threaded portion 8 of the cylinder H, and then the washer is brought into contact with the inner surface of the box wall. Finally another nut K, is slid over the cylindrical sleeve D, and it has an inwardly extending flange 15 that will abut the exposed portion of the split ring G and will force it into the chamfered end of the cylinder to compress the ring into binding relation with the sleeve D. The coupling is now completely assembled and will secure the cable C against any removal from the cylinder D when the nut K is threaded upon the threaded portion 8 of the cylinder H. Any outward pull on the cable will merely cause the teeth 5 on the wedges F to grip the cable tighter. The right hand ends 7 of the wedges will abut the end of the threaded portion 8 of the cylinder, and anchor the wedges in place. The cable C has wires 16 that extend through the central opening in the nut flange 13 and are connected to the twin electric sockets B, within the box A, or to any other electrical unit within the box.

Figure 4:
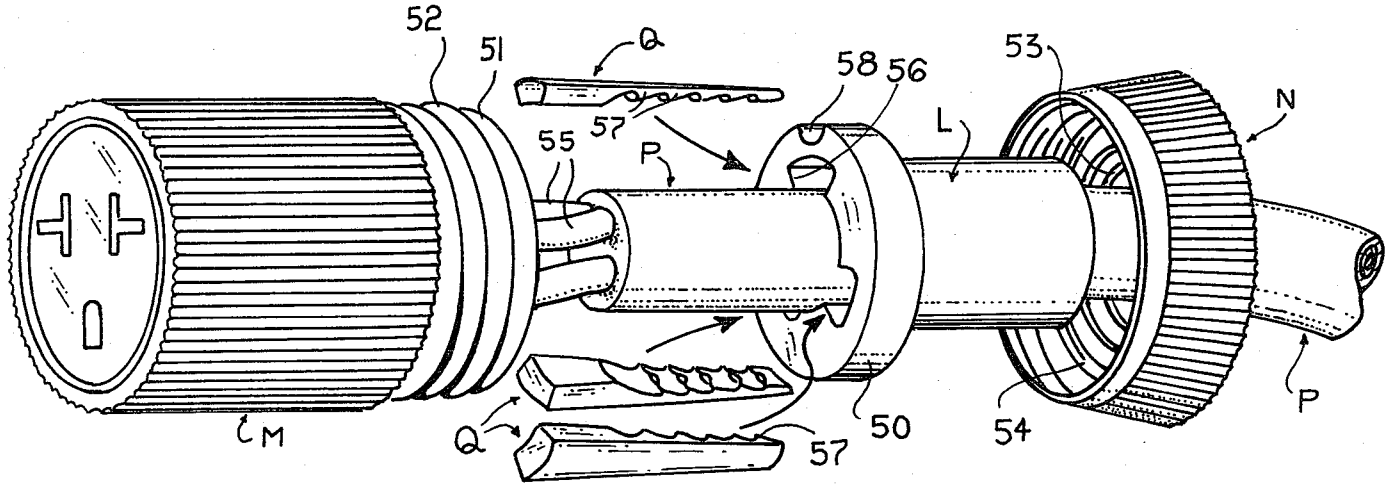
FIG. 4 is an enlarged exploded view of my coupling when applied to an electric socket for connecting the cable thereto.
Figure 5:
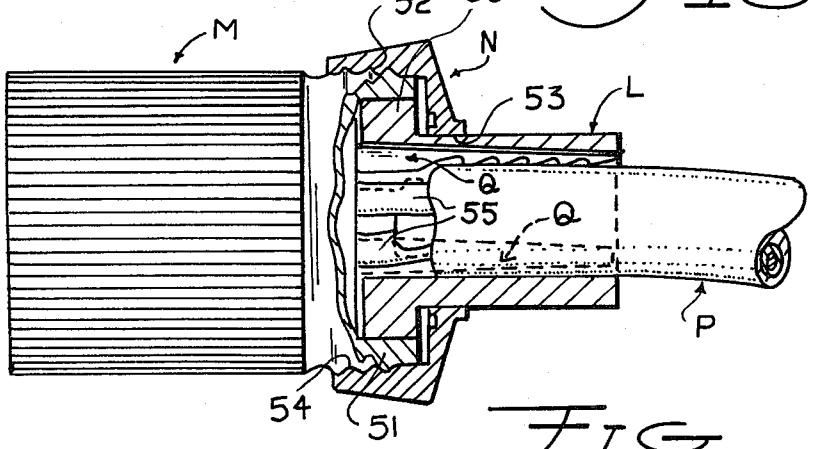
FIG. 5 is a sectional view through the coupling and illustrates how the coupling is connected to the electric socket.

The coupling is slightly modified when connected to an electric socket. Reference to FIGS. 4 and 5 illustrate this type of coupling. A sleeve L has an enlarged circular base 50 which is received within the interior of a cylindrical portion 51 of an electric socket M, see FIG.

5. The portion 51 is exteriorly threaded at 52 and a cap N has a central opening 53 slidably receiving the sleeve L, and the cap is interiorly threaded at 54 and this permits the cap to connect the sleeve to the socket M.

The cable P is inserted through the cap N and the sleeve L with the wires 55 in the cable extending beyond the cable end and being connected to the electrodes, not shown, in either FIGS. 4 or 5, in the socket M. The sleeve L and its base 50 are provided on their interior with three wedge-shaped elongated grooves 56 that receive the three wedges Q. These wedges are similar to the wedges F, and they are provided with teeth 57 on their inner surfaces which will grip the cable P, as is shown in FIG. 5. When the parts are assembled as shown in this figure, the cable P will be permanently connected to the socket M, and the wedges will prevent the cable from being pulled loose from the socket. The base 50 of the sleeve L has a key slot 58 in its periphery, see FIG. 4, and it receives a longitudinal key, not shown, in the socket M, for properly positioning the sleeve base 50 in the socket.

I claim:

1. In a coupling for an electric cable; the improvement comprising:

(a) a sleeve receiving the cable in extension therethrough;

(b) a liner received within the sleeve and having longitudinally extending wedge-shaped grooves, the portions of the liner lying between adjacent grooves having their inner faces contacting the cable; and (c) wedges received in the grooves and having teeth on their inner surfaces for gripping the cable, the teeth being inclined for digging into the cable when the cable is pulled away from the coupling, whereby the teeth prevent any longitudinal movement in the sleeve.

2. The combination as set forth in claim 1 for mechanically connecting said cable to an electric outlet box; further comprising (a) a cylinder having exterior treads about an inner end extending through a box wall opening, and a flange about an outer end contacting the other side of the wall;

(b) said cylinder having an internally chamfered inner end;

(c) a split ring on the sleeve contacting the inner end of said cylinder; and (d) a nut having a cylindrical threaded interior for mating with the threaded portion of said cylinder, said nut having an inwardly extending flange for contacting said split ring and forcing it against the inner end of said cylinder to compress the ring into binding relation with said sleeve.

* * * * *